US008590631B2

(12) United States Patent
Sprakel et al.

(10) Patent No.: US 8,590,631 B2
(45) Date of Patent: Nov. 26, 2013

(54) FIREFIGHTING IN RAILWAY VEHICLES

(75) Inventors: Dirk Sprakel, Köln (DE); Roger Dirksmeier, Menden (DE); Max Lakkonen, Rösrath (DE)

(73) Assignee: FOGTEC Brandschutz GmbH & Co. KG, Köln (DE)

( * ) Notice: Subject to any disclaimer, the term of this patent is extended or adjusted under 35 U.S.C. 154(b) by 926 days.

(21) Appl. No.: 11/997,695

(22) PCT Filed: Aug. 21, 2006

(86) PCT No.: PCT/EP2006/065516

§ 371 (c)(1),
(2), (4) Date: Feb. 15, 2008

(87) PCT Pub. No.: WO2007/023150

PCT Pub. Date: Mar. 1, 2007

(65) Prior Publication Data

US 2008/0223955 A1 Sep. 18, 2008

(30) Foreign Application Priority Data

Aug. 22, 2005 (DE) ..... 20 2005 013 281 U

(51) Int. Cl.
*A62C 37/00* (2006.01)

(52) U.S. Cl.
USPC ..... 169/55; 169/23; 169/56

(58) Field of Classification Search
USPC ..... 169/54, 55, 56, 23
See application file for complete search history.

(56) References Cited

U.S. PATENT DOCUMENTS

| | | | | | |
|---|---|---|---|---|---|
| 1,383,788 | A | * | 7/1921 | Clark | 169/62 |
| 1,962,977 | A | | 6/1934 | Whitsitt | |
| 2,298,062 | A | * | 10/1942 | Lewis | 169/17 |
| 4,121,665 | A | * | 10/1978 | Woycheese | 169/38 |
| 5,117,916 | A | * | 6/1992 | Ohta et al. | 169/37 |
| 5,628,368 | A | * | 5/1997 | Sundholm | 169/61 |
| 5,857,525 | A | * | 1/1999 | Okamoto et al. | 169/11 |

FOREIGN PATENT DOCUMENTS

| | | |
|---|---|---|
| EP | 0650743 A1 | 5/1995 |
| GB | 2139495 | 11/1984 |
| KR | 20-0319389 | 7/2003 |
| WO | 02089921 | 11/2002 |

OTHER PUBLICATIONS

International Search Report, Application No. PCT/EP2006/065516, Jun. 12, 2006, 4 pages.
European Search Report, Application No. EP 06 11 0184, Nov. 23, 2006, 8 pages.

(Continued)

*Primary Examiner* — Davis Hwu
(74) *Attorney, Agent, or Firm* — Sunstein Kann Murphy & Timbers LLP

(57) ABSTRACT

The invention relates to a railway vehicle comprising a fire-fighting system having a supply container for extinguishing agent, a system of pipes, means for dispensing extinguishing agent, and a pressure-generating means. To improve the reliability of this system, it is proposed that the pressure-generating means be coupled to a compressed-air supply belonging to the railway vehicle, that a quiescent pressure can be generated in the system of pipes with the help of the pressure-generating means, and that a case of fire can be detected by means of a pressure drop in the system of pipes.

10 Claims, 1 Drawing Sheet

(56) References Cited

OTHER PUBLICATIONS

Cote et al., "Fire Protection Handbook," National Fire Protection Association, Sixteen Edition, 7 pages, 1986.

Railtrack PLC, "Requirements for the Control of Risks Arising from Fires on Railway Vehicles," Railway Group Standard, GM/RT2120, Issue One, 15 pages, Aug. 1998.

Railtrack PLC, "Code of Practice-Traction & Rolling Stock Fire Protection Systems," Railway Group Code of Practice, GM/RC2506, Issue One, 6 pages, Aug. 1998.

HI-FOG, "Fire Protection on the Rolling Stock of Metro de Madrid," Marioff HI-FOG, S.A., 25 pages, undated.

Marioff Corporation OY, "Delivery Note 133267," dated Mar. 15, 2001, 2 pages.

Marioff Corporation OY, "Certificate of Compliance," Certificate No. SP/20/2002, 1 page, Feb. 25, 2002.

Dudenverlag, Duden, Deutsches Universalworterbuch, 5 pages, 2007.

Korean Patent Office, Office Action, Application No. 7006720/2008, dated Jul. 27, 2012, 6 pages.

European Patent Office, Interlocutory Decision, Application No. 06110184.6-1258, dated Jul. 13, 2012, 19 pages.

* cited by examiner

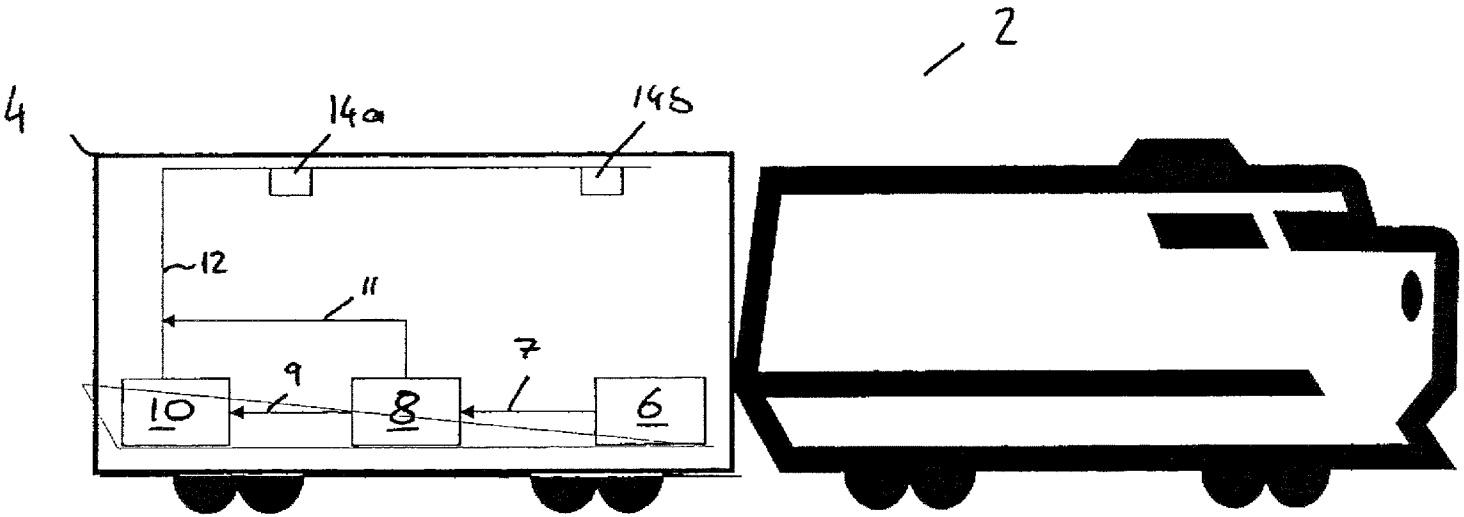
2
4
14a
14b
6
7
8
9
10
11
12

FIREFIGHTING IN RAILWAY VEHICLES

CROSS-REFERENCE TO RELATED APPLICATIONS

The present application claims priority from German application serial number 20 2005 031 281.0, filed on Aug. 22, 2005.

BACKGROUND OF THE INVENTION

In a modern-day society, increasing use is being made of railway vehicles to perform infrastructural tasks in the area of passenger transport. Particularly stringent fire protection requirements have, of course, to be laid down for the relevant passenger trains. Hitherto, this has been reflected in stringent requirements for the material and equipment used in the trains. Corresponding standards and other requirements relating to the design of trains and to their construction and to the materials and equipment selected constitute not inconsiderable restrictions on the makers and operators of trains when new projects are being carried out. When vehicles belonging to old rolling stock are being brought up to a fit state, it is only with difficulty, or not at all, that the conditions imposed by the authorities can be met.

It can be expected that, in the next few years too, rail systems are increasingly going to be laid wholly or partly underground. Because of the particular problems that fire protection poses in tunnels, there will therefore continue to be a steady rise in the requirements that railway vehicles have to meet.

Added to this is the fact that it is only the way in which the rolling stock itself behaves in fires that can be influenced by the design of the vehicles and by the materials and equipment selected. There is on the other hand no way in which the fire loads such as clothing and luggage which the passengers take on with them can be influenced. Even the taking on of incendiary materials by arsonists is almost impossible to prevent.

The fire-fighting systems for the spaces occupied by passengers which have hitherto been installed in railway vehicles, which has only happened anyway in exceptional cases, have mostly been of the "open system" or "wet system" types.

In the first case, it is necessary in addition for a fire detection and alarm system to be installed which will detect fires and will then give the fire-fighting system an activating signal for the area affected. To keep down the system costs in terms of valves controlling the area, the particular devices for dispensing extinguishing agent are not activated individually but, regularly, in groups. The result of this is that the amount of extinguishing agent used is greater than it would be in the case of selective individual activation. This in turn means that the supply of extinguishing agent, and hence the weight which has to be carried, turns out to be higher.

In the wet system, the devices for dispensing extinguishing agent are activated by thermal triggering elements in the individual devices. This gives individual activation. However, the entire pipe network out as far as the devices for dispensing the extinguishing agent has to be pre-filled with extinguishing agent in this case. This is not without its problems, because in certain circumstances the vibration typical of railway vehicles might causes leaks of greater or lesser severity in the network of piping, allowing the extinguishing agent to escape, as a result of which not inconsiderable damage might be done even though the amounts were very small.

The above-mentioned measures for improving fire protection are what are called passive measures. As described, they are a considerable restriction on makers and operators. There are significant imposed tasks which cannot be performed at all by passive fire protection measures.

SUMMARY OF THE INVENTION

It is therefore an object of the invention to reduce these problems or at least to considerably moderate them.

The scheme which is described here makes provision for the pipes which connect the supply container for extinguishing agent (or the pump) to the devices for dispensing the extinguishing agent to be filled with a gas, or air, under pressure.

One aspect of the invention is a railway vehicle according to claim 1. Another aspect is a fire-fighting arrangement.

If one of the devices for dispensing extinguishing agent opens as a result of being acted on thermally, the pressure in the system of pipes drops and, via a suitable arrangement, the mechanism which cuts off the pipe from the extinguishing agent is opened. Following this, the network of piping is filled with extinguishing agent, whereupon the latter can emerge from the device or devices for dispensing extinguishing agent which have been activated previously.

If however gas/air escapes not as a result of a device for dispensing extinguishing agent being activated but because of a (fairly small) leak, the network of piping is not filled with extinguishing agent but further gas/air is fed in until the usual test pressure has been reached again in the network of piping.

It would be particularly advantageous if the pipe system were full of air when in the "standby" mode and if this air were to originate from the vehicle's compressed-air system. In this way, the carrying of additional pressurised containers could be dispensed with.

A particular further embodiment of the system would be one in which the compressed air from the vehicle was also used to drive extinguishing agent out of a container for extinguishing agent and into the network of piping.

A further embodiment of the system would make provision in addition for (simple) fire alarms. Only if there were a fire signal from the fire alarms and, at the same time, a significant drop in pressure would the network of piping be filled with extinguishing agent. If only the "pressure drop" signal occurs, it acts as an alarm message for a leak. It is important for the network of piping to be monitored continuously for leaks so that the ability to operate is ensured in emergency cases. The option of simply leaving the network of piping unfilled and without any gas/air applied in the standby mode thus is removed.

DESCRIPTION OF ILLUSTRATIVE EMBODIMENTS

FIG. 1 shows a railway vehicle 2 having a fire-fighting system. A compressed-air supply 6 is provided in a wagon 4. The compressed-air supply 6 may be provided both in the wagon 4 and in the motive unit. Pneumatically operated functional facilities of the railway vehicle 2 are driven by means of the compressed-air supply 6. These may for example be the brakes. As well as the compressed-air supply 6, what are also provided in the wagon 4 are a pressure-generating means 8 and a supply container 10 for extinguishing agent. For fire-fighting purposes, there is a system of pipes 12 coupled to the supply container 10 for extinguishing agent. Arranged on the system of pipes 12 are fog nozzles 14*a*, 14*b*. The arrangement described operates as follows:

In the quiescent state, compressed air is fed from the compressed-air supply 6 into the pressure-generating means 8 via the pipe 7. With the help of the compressed air taken from the compressed-air supply 6, a quiescent pressure is generated in the system of pipes 12 by means of the pressure-generating means 8. For this purpose, there is a connection 11 between the system of pipes 12 and the pressure-generating means 8. The quiescent pressure may be a few bars. Leaks in the system of pipes 12 cause slight pressure drops in the mbar range, the pressure drops being sluggish, i.e. taking place over a long period. Such pressure drops are detected in the pressure-generating means 8 via the connection 11. The quiescent pressure is corrected by means of compressed air taken from the compressed-air supply 6. What is achieved by this means is that a constant quiescent pressure prevails in the system of pipes 12.

In the event of a fire, the fire can be detected by means of burst-actuated pistons in the fog nozzles 14. This happens as a result of the fact that the burst-actuated pistons shatter due to the increase in temperature and the compressed air in the system of pipes 12 is able to escape. Other means of detection are also possible. The compressed air 12 can be used for fire detection, meaning that in the event of a fire, and in particular as a result of the increase in temperature, the system of pipes 12 is opened and the compressed air is able to escape. As well as this, a separate fire alarm (not shown) may be provided by means of which a fire can be indicated manually.

It is now proposed that, in the event of a fire, i.e. if there is at least a pressure drop in the system of pipes 12, but preferably if there is both a pressure drop in the system of pipes 12 and also a report of fire made by the fire alarm, compressed air from the pressure-generating means 8 is driven via the connection 9 into the supply container 10 for extinguishing agent. The compressed air causes extinguishing fluid to flow out of the supply container 10 for extinguishing agent and into the system of pipes 12 and, after a short time, to be applied to the fog nozzles 14. It is preferable for the pressure-generating means 8 to generate a high pressure, such for example as 80 to 200 bars. What is achieved by this means is that an extinguishing fog is produced at the fog nozzles 14.

If a fire is detected, which can be done in the pressure-generating means 8, via the connection 11, as a result of a pressure drop in the system of pipes 12, then high pressure is generated in the supply container 10 for extinguishing agent. This is able to cause a connection, initially closed, to be opened between the supply container 10 for extinguishing agent and the system of pipes 12. This connection may be closed off by means of, for example, a burst disc which bursts at an increased pressure and also by means of a valve. In the event of a fire, the connection 11 to the system of pipes 12 is shut off in the pressure-generating means 8 and the air pressure is taken into the supply container 10 for extinguishing agent via the connection 9.

As well as air, any other gas may also be used to generate the high pressure in the system of pipes 12.

As a result of the coupling according to the invention between the compressed-air supply 6 and the pressure-generating means 8, pumps which are already present in the wagons 4 may be given over to a further use. The cost and effort of installing a fire-fighting system for railway vehicles is reduced. The capital investment costs remain low and the cost and effort of maintenance can be minimised.

What is claimed is:

1. A railway vehicle fire-fighting system, comprising:

a supply container for an extinguishing agent;

a system of pipes connecting the supply container with means for dispensing the extinguishing agent;

a means for maintaining a constant quiescent pressure in the system of pipes, wherein the means for maintaining the constant quiescent pressure is coupled to a compressed-air supply belonging to the railway vehicle, the means for maintaining the constant quiescent pressure filling the system of pipes with gas at the quiescent pressure, whereby in a case of fire the gas filling the pipes escapes the pipes such that the fire is detected by a pressure drop of the gas filling the pipes and the compressed-air supply drives the extinguishing agent by air pressure out of the supply container, into the system of pipes, and out of the means for dispensing; and a fire alarm coupled to the system such that detection of a fire allows the compressed air from the compressed-air supply to be driven into the supply container whereby the extinguishing agent flows out of the supply container, into the system of pipes, and out of the means for dispensing.

2. A fire-fighting system of claim 1, wherein in the event of a fire the means for dispensing extinguishing agent causes the pressure drop.

3. A fire-fighting system of claim 1, wherein the pressure drop in the event of a fire is greater than a pressure drop due to leaks in the system of pipes.

4. A fire-fighting system of claim 1, wherein in the event of a fire a burst-actuated piston in the means for dispensing extinguishing agent allows the gas to escape from the system of pipes, thereby causing the pressure drop.

5. A fire-fighting system of claim 1, wherein the pressure drop of the gas filling the pipes, establishes a fluid connection between the supply container for the extinguishing agent and the system of pipes.

6. A fire-fighting system of claim 5, wherein a bursting disc or a valve establishes the fluid connection between the supply container for the extinguishing agent and the system of pipes.

7. A fire-fighting system of claim 1, wherein in the event of a fire, the extinguishing agent can be dispensed from the means for dispensing extinguishing agent at a high pressure of between 80 and 200 bars.

8. A fire-fighting system of claim 1, wherein in the event of a fire, the means for dispensing extinguishing agent produces an extinguishing fog.

9. A fire-fighting system of claim 1, wherein the means for dispensing extinguishing agent has at least one fog nozzle.

10. Railway vehicle comprising a fire-fighting system of claim 1.

* * * * *

UNITED STATES PATENT AND TRADEMARK OFFICE

CERTIFICATE OF CORRECTION

PATENT NO. : 8,590,631 B2
APPLICATION NO. : 11/997695
DATED : November 26, 2013
INVENTOR(S) : Sprakel et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 777 days.

Signed and Sealed this
Twenty-second Day of September, 2015

Michelle K. Lee

Michelle K. Lee
*Director of the United States Patent and Trademark Office*